US009403377B2

(12) United States Patent
Mindler et al.

(10) Patent No.: US 9,403,377 B2
(45) Date of Patent: Aug. 2, 2016

(54) SYSTEM AND METHOD FOR DETERMINING RECEIVER TYPE IN A THERMAL PRINTER

(71) Applicant: Kodak Alaris Inc., Rochester, NY (US)

(72) Inventors: Robert Fredric Mindler, Churchville, NY (US); Young No, Pittsford, NY (US); Gregory James Garbacz, Rochester, NY (US); Dennis W. Heizyk, Rochester, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 14/871,300

(22) Filed: Sep. 30, 2015

(65) Prior Publication Data

US 2016/0016416 A1 Jan. 21, 2016

Related U.S. Application Data

(63) Continuation of application No. 14/460,014, filed on Aug. 14, 2014, now Pat. No. 9,162,491.

(60) Provisional application No. 61/866,214, filed on Aug. 15, 2013, provisional application No. 61/866,204, filed on Aug. 15, 2013.

(51) Int. Cl.

| | |
|---|---|
| ***B41J 2/355*** | (2006.01) |
| ***B41J 2/325*** | (2006.01) |
| ***B41J 11/00*** | (2006.01) |

(52) U.S. Cl.
CPC ..... *B41J 2/3558* (2013.01); *B41J 2/325* (2013.01); *B41J 11/009* (2013.01)

(58) Field of Classification Search
CPC ..... B41J 2/35; B41J 2/355; B41J 2/3553; B41J 2/3555; B41J 2/3556; B41J 2/3558; B41J 3/255
See application file for complete search history.

(56) References Cited

U.S. PATENT DOCUMENTS

2007/0024693 A1* 2/2007 Anderson ..... B41J 2/355 347/213
2012/0200654 A1* 8/2012 Arrington ..... B41J 2/32 347/171

* cited by examiner

*Primary Examiner* — Kristal Feggins
(74) *Attorney, Agent, or Firm* — Hogan Lovells US LLP

(57) ABSTRACT

The present invention is directed to systems and methods of directly determining the type of receiver media loaded in a thermal printer by measurements taken from the receiver media itself. In one embodiment, a tri-color emitter and detector combination work in conjunction to determine the intensity of light transmitted through the receiver media. The type of receiver media may be determined by the voltage response or transmission profile generated by the receiver in response to being illuminated by the tri-color emitter.

19 Claims, 15 Drawing Sheets

Donor Dye Patch Sensing
Emitter / Detector Response

| Emitter / Patch | Red | Green | Blue |
|---|---|---|---|
| Yellow | High | High | Low |
| Magenta | High | Low | High |
| Cyan | Low | High | High |
| Clear | High | High | High |

*FIG. 11*

*FIG. 14*

Donor Size and Type: "A" or "B" or "C" or "NA"

Paper Type: "A" or "B" or "C" or "NA"

| Donor Size / Type | "A" | "B" | "C" | "NA" |
|---|---|---|---|---|
| Paper Type "A" | LUT 1 | LUT 2 | LUT 3 | Error |
| "B" | LUT 4 | LUT 5 | LUT 6 | Error |
| "C" | LUT 7 | LUT 8 | LUT 9 | Error |
| "NA" | Error | Error | Error | Error |

SYSTEM AND METHOD FOR DETERMINING RECEIVER TYPE IN A THERMAL PRINTER

CROSS-REFERENCE TO RELATED CASES

This application is a continuation of U.S. patent application Ser. No. 14/460,014, filed on Aug. 14, 2014, and claims the benefit of U.S. Provisional Application Ser. No. 61/866,214, entitled "System for determining Receiver Type in a Thermal Printer," filed on Aug. 15, 2013; and U.S. Provisional Application Ser. No. 61/866,204, entitled "Method for Determining Receiver Type in a Thermal Printer," filed on Aug. 15, 2013. These patent applications are hereby incorporated by reference in their entirety.

FIELD OF THE INVENTION

This invention pertains to a system and method for determining the type of receiver media in a thermal printer.

BACKGROUND OF THE INVENTION

In thermal dye sublimation printing, it is generally well known to render images by heating and pressing one or more donor materials such as a colorant (e.g., a dye) or other coating against a receiver medium having a colorant receiving layer. The heat is generally supplied by a thermal print head having an array of heating elements. The donor materials are typically provided in sized donor patches on a movable web known as a donor ribbon. The donor patches are organized on the ribbon into donor sets, each set containing all of the donor patches that are to be used to record an image on the receiver web. For full color images, multiple color dye patches can be used, such as yellow, magenta, and cyan donor dye patches. Arrangements of other color patches can be used in like fashion within a donor set. Additionally, each donor set can include an overcoat or sealant layer.

Thermal printers offer a wide range of advantages in photographic printing, including the provision of truly continuous tone scale variation and the ability to deposit, as a part of the printing process a protective overcoat layer to protect the images formed thereby from mechanical and environmental damage. Accordingly, many photographic kiosks and home photo printers currently use thermal printing technology.

It is advantageous for a thermal printer to adjust the operation of the thermal print head depending on the type of receiver media that is loaded in the thermal printer. However, current methods of determining the type of receiver media have a significant drawback because they do not determine the type of receiver media directly. In current roll feed thermal printers, the only way to determine receiver media type is to read the bar code label located on the donor media roll spool. This requires the printer's bar code reader to scan the donor media spool at the outset, prior to printing. The bar code pattern on the donor media spool theoretically corresponds with the particular type of receiver media that should be used in conjunction with the certain type of donor media. The bar code is processed by the printer's firmware to determine if the media type is correct, what size media is loaded, and which look-up table (LUT) should be used for the media type.

Donor media and receiver media are generally sold and implemented as kits—in other words, as complementary pairs—to optimize printing quality. Using donor media from one kit with receiver media from another kit may result in markedly reduced printing quality. Current methods determine the type of donor dye supply roll and then assume that the receiver media is a type that is appropriate for the donor dye supply roll. Thus, the problem with the media type detection process currently implemented in industry is that the receiver media type is being determined solely based on the donor dye supply roll, which may not necessarily align with the receiver type that would optimize printing quality.

An improvement needs to be made so that both donor media type and receiver media type can be determined without having to implement any new printer hardware to achieve complete backwards compatibility.

SUMMARY OF THE INVENTION

The present invention is directed to systems and methods of directly determining the type of receiver media loaded in a thermal printer by measurements taken from the receiver media itself.

According to an aspect of the present invention, a method for controlling a thermal printer after determining receiver type used in such thermal printer, comprises providing a thermal printer having a thermal print head and defining a printing zone wherein a receiver receives colorant from a donor in response to the thermal print head producing heat, moving the receiver between an emitter and a detector in the thermal printer, wherein the emitter illuminates the receiver and the detector produces voltage responses based on the illumination of the receiver, using a processor to generate a profile of voltage responses, receiving a set of known profiles of voltage responses associated with known receiver types, and comparing the measured profile of voltage responses with the set of known profiles of voltage responses to determine receiver type, and controlling the amount of heat generated by the thermal print head in response to the determined receiver type.

The receiver is provided in a thermal printer. The donor medium can be moved to a clear patch to allow unaltered transmission of emitted light. The measured profile of voltage responses can also be adjusted to account for the response of a patch of a donor medium.

An embodiment of the present invention provides a method for determining a receiver type in a thermal printer, wherein the thermal printer comprises a thermal print head, a plurality of rollers, an emitter, and a detector. The method comprises the following steps: First, the method requires using one or more rollers to advance the receiver between the emitter and the detector. Once positioned there, the emitter illuminates the receiver by emitting a tri-color light upon the receiver. The detector registers a voltage transmission based on the illumination of the receiver. As used herein, voltage transmission and voltage response are to be understood to be the same. Thereafter, the printer generates a measured voltage transmission profile, receives a set of known voltage transmission profiles, and compares the measured voltage transmission profile to the set of known voltage transmission profiles to determine the receiver type.

A related embodiment provides a method for optimizing printing quality by a thermal printer loaded with a donor medium and a receiver medium. The method comprises the following steps: First, the printer determines the type of donor medium installed. Then, it determines the type of receiver medium installed. This step can be performed according to the method described in the preceding paragraph or according to any other method described herein. Once the donor medium type and receiver medium type are known, the printer controller uses the known donor medium type and the known receiver medium type to determine the optimum look-up table, wherein the optimum look-up table comprises optimum printing specifications. Lastly, the printer prints according the optimum printing specifications of the optimum look-up table.

In another embodiment of the present invention, the emitter emits light of a particular frequency, including red, green, or blue. The intensity of the emitted light can also be adjusted. The voltage response of the emitted light transmitted through the receiver can be measured at a predetermined sampling rate, for example, at every 10 mm, as the receiver is transported through the thermal printer. In another embodiment, the voltage response of the emitted light transmitted through the receiver can be measured continuously. The receiver type can be paper, transparency material, sticker material, or cloth material.

In another embodiment, the receiver can be moved in a first direction to generate a first profile of voltage responses. Then, the receiver can be moved in a second direction to generate a second profile of voltage responses. The first profile of voltage responses can be compared with the second profile of voltage responses to generate an error between the first and second profiles of voltage responses and a confidence value can be assigned to the determination of receiver type based on the error.

A further embodiment provides a system for determining receiver type in a thermal printer, wherein the thermal printer has a thermal print head and a printing zone in which colorant from donor medium transfers to the receiver in response to the thermal print head producing heat. The system comprises an emitter located proximate to the printing zone of the thermal printer for illuminating the receiver; a detector located proximate to the printing zone of the thermal printer for producing a voltage response based on the illumination of the receiver when the receiver is moved through the printing zone of the thermal printer; and a processor configured to generate a profile of measured voltage responses, to receive a set of known profiles of voltage responses associated with known receiver types, and to determine the receiver type by comparing the profile of measured voltage responses with the set of profiles of voltage responses associated with known receiver types.

These embodiments and other aspects and features of the present invention will be better appreciated and understood when considered in conjunction with the following description and the accompanying drawings. The summary descriptions above are not meant to describe individual separate embodiments whose elements are not interchangeable. In fact, many of the elements described as related to a particular embodiment can be used together with, and possible interchanged with, elements of other described embodiments. Many changes and modifications may be made within the scope of the present invention without departing form the spirit thereof, and the invention includes all such modifications. The figures are intended to be drawn neither to any precise scale with respect to relative size, organizational relationship, or relative position, nor to any combinational relationship with respect to interchangeability, substitution, or representation of an actual implementation.

BRIEF DESCRIPTION OF THE DRAWINGS

FIG. 11 shows the emitter detector response based on various combinations of emitted light and donor dye patches;

FIG. 14 shows an example of selection of lookup tables ("LUTs") based on detected media and donor type.

It is to be understood that the attached drawings are for purposes of illustrating the concepts of the invention and may not be to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 1:
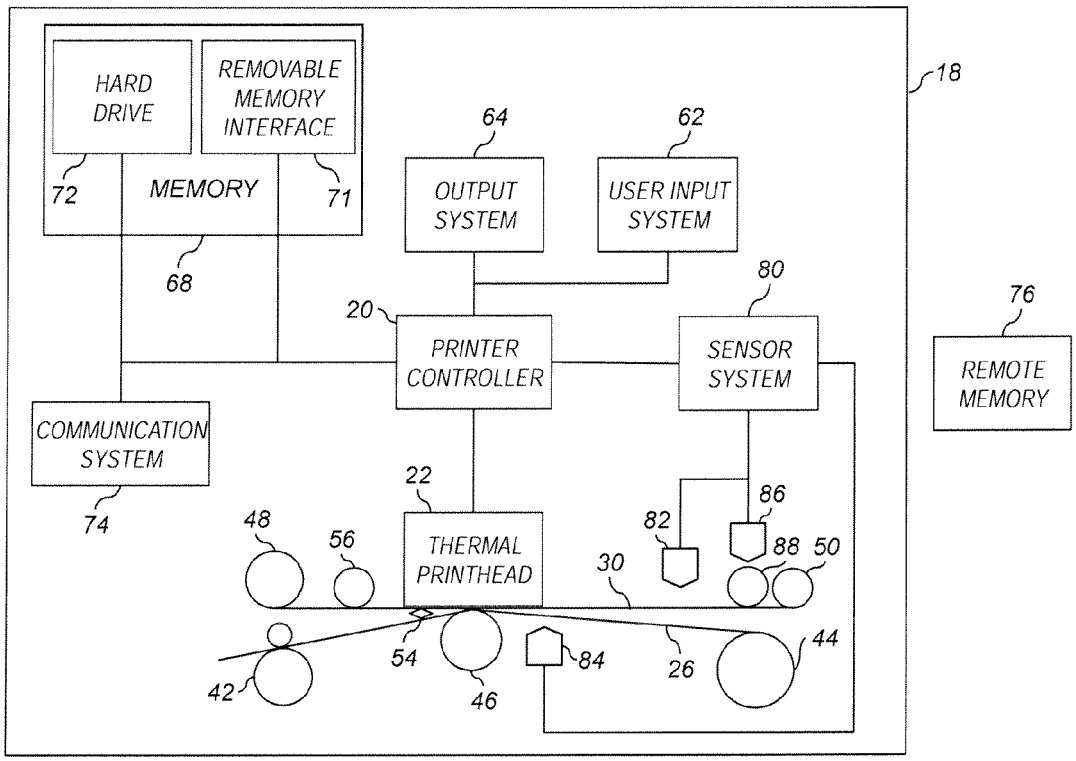
FIG. 1 shows a system diagram for an exemplary thermal printing system.

FIG. 1 shows a system diagram for an exemplary thermal printer 18 in accordance with the present invention. As shown in FIG. 1, thermal printer 18 has a printer controller 20 that causes a thermal printhead 22 to record images onto receiver media 26 by applying heat and pressure to transfer material from a donor ribbon 30 to receiver media 26. The receiver media 26 includes a dye receiving layer coated on a substrate. As used herein, the term "receiver media" is used synonymously with the terms "thermal imaging receiver" and "thermal media." Similarly, the term "donor ribbon" is used synonymously with the terms "thermal donor" and "donor web."

Printer controller 20 can include, but is not limited to: a programmable digital computer, a programmable microprocessor, a programmable logic controller, a series of electronic circuits, a series of electronic circuits reduced to the form of an integrated circuit, or a series of discrete components. In the embodiment of FIG. 1, printer controller 20 also controls a receiver drive roller 42, a receiver supply roll 44, a donor ribbon take-up roll 48, and a donor ribbon supply roll 50;

which are each motorized for rotation on command of the printer controller 20 to effect movement of receiver media 26 and donor ribbon 30.

Figure 2:
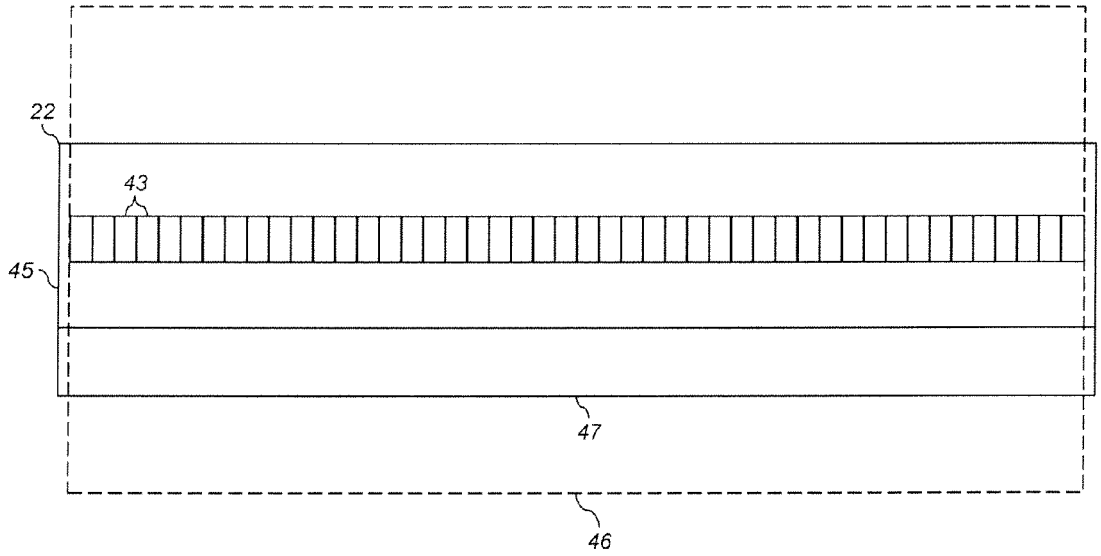
FIG. 2 is a diagram showing a bottom view of a thermal printhead.

FIG. 2 shows a bottom view of one embodiment of a typical thermal printhead 22 with an array of thermal resistors 43 fabricated in a ceramic substrate 45. A heat sink 47, typically in the form of an aluminum backing plate, is fixed to a side of the ceramic substrate 45. Heat sink 47 rapidly dissipates heat generated by the thermal resistors 43 during printing. In the embodiment shown in FIG. 2, the thermal resistors 43 are arranged in a linear array extending across the width of platen roller 46 (shown in phantom). Such a linear arrangement of thermal resistors 43 is commonly known as a heat line or print line. However, other non-linear arrangements of thermal resistors 43 can be used in various embodiments. Further, it will be appreciated that there are a wide variety of other arrangements of thermal resistors 43 and thermal printheads 22 that can be used in conjunction with the present invention.

The thermal resistors 43 are adapted to generate heat in proportion to an amount of electrical energy that passes through thermal resistors 43. During printing, printer controller 20 transmits signals to a circuit board (not shown) to which thermal resistors 43 are connected, causing different amounts of electrical energy to be applied to thermal resistors 43 so as to selectively heat donor ribbon 30 in a manner that is intended to cause donor material to be applied to receiver media 26 in a desired manner.

Figure 3A:
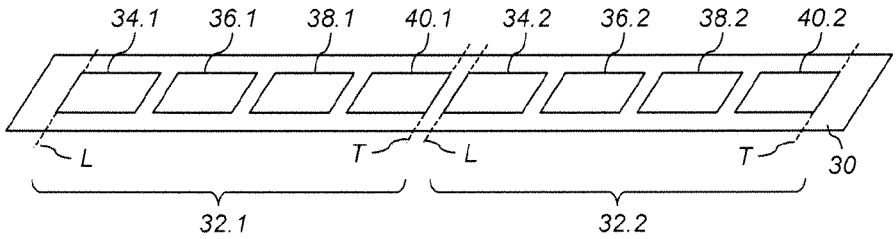
FIG. 3A is a diagram illustrating a donor ribbon having four different donor patches.
Figure 3B:
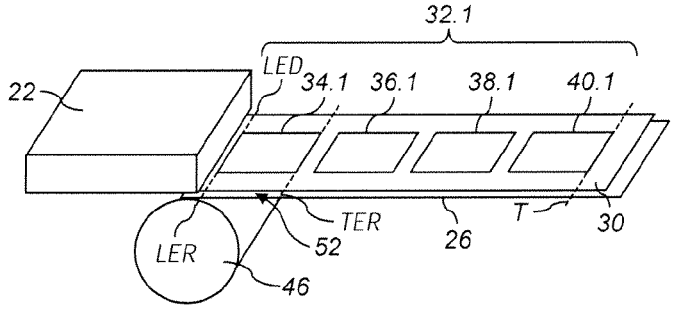
FIGS. 3B-3C illustrates a printing operation.

As is shown in FIG. 3A, donor ribbon 30 comprises a first donor patch set 32.1 having a yellow donor patch 34.1, a magenta donor patch 36.1, a cyan donor patch 38.1 and a clear donor patch 40.1; and a second donor patch set 32.2 having a yellow donor patch 34.2, a magenta donor patch 36.2, a cyan donor patch 38.2 and a clear donor patch 40.2. Each donor patch set 32.1 and 32.2 has a patch set leading edge L and a patch set trailing edge T. In order to provide a full color image with a clear protective coating, the four patches of a donor patch set; are printed, in registration with each other, onto a common image receiving area 52 of receiver media 26 shown in FIG. 3B. The printer controller 20 (FIG. 1) provides variable electrical signals in accordance with input image data to the thermal resistors 43 (FIG. 2) in the thermal printhead 22 in order to print an image onto the receiver media 26. Each color is successively printed as the receiver media 26 and the donor ribbon move from right to left as seen by the viewer in FIG. 3B.

During printing, the printer controller 20 raises thermal printhead 22 and actuates donor ribbon supply roll 50 (FIG. 1) and donor ribbon take-up roll 48 (FIG. 1) to advance a leading edge L of the first donor patch set 32.1 to the thermal printhead 22. In the embodiment illustrated in FIGS. 3A-3C, leading edge L for first donor patch set 32.1 is the leading edge of yellow donor patch 34.1. As will be discussed in greater detail below, the position of this leading edge L can be determined by using a position sensor to detect appropriate marking indicia on donor ribbon 30 that has a known position relative to the leading edge of yellow donor patch 34.1 or by directly detecting the leading edge of yellow donor patch 34.1.

Printer controller 20 also actuates receiver drive roller 42 (FIG. 1) and receiver supply roll 44 (FIG. 1) so that image receiving area 52 of receiver media 26 is positioned with respect to the thermal printhead 22. In the embodiment illustrated, image receiving area 52 is defined by a receiving area leading edge LER and a receiving area trailing edge TER on receiver media 26. Donor ribbon 30 and receiver media 26 are positioned so that donor patch leading edge LED of yellow donor patch 34.1 is registered at thermal printhead 22 with receiving area leading edge LER of image receiving area 52. Printer controller 20 then causes a motor or other conventional structure (not shown) to lower thermal printhead 22 so that a lower surface of donor ribbon 30 engages receiver media 26 which is supported by platen roller 46. This creates a pressure holding donor ribbon 30 against receiver media 26.

Printer controller 20 then actuates receiver drive roller 42 (FIG. 1), receiver supply roll 44 (FIG. 1), donor ribbon take-up roll 48 (FIG. 1), and donor ribbon supply roll 50 (FIG. 1) to move receiver media 26 and donor ribbon 30 together past the thermal printhead 22. Concurrently, printer controller 20 selectively operates thermal resistors 43 (FIG. 2) in thermal printhead 22 to transfer donor material from yellow donor patch 34.1 to receiver media 26.

Figure 3C:
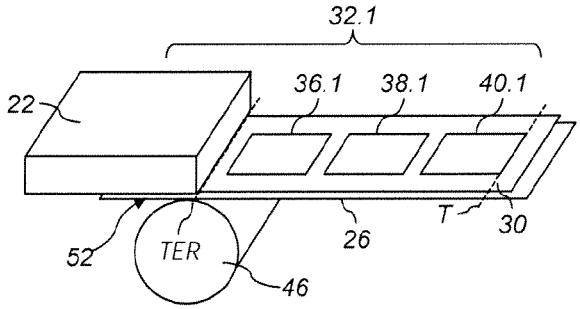

As donor ribbon 30 and receiver media 26 leave the thermal printhead 22, a peel member 54 (FIG. 1) separates donor ribbon 30 from receiver media 26. Donor ribbon 30 continues over idler roller 56 (FIG. 1) toward the donor ribbon take-up roll 48. As shown in FIG. 3C, printing continues until the receiving area trailing edge TER of image receiving area 52 of receiver media 26 reaches the printing zone between the thermal printhead 22 and the platen roller 46. The printer controller 20 then adjusts the position of donor ribbon 30 and receiver media 26 using a predefined pattern of movements so that a leading edge of each of the next donor patches (i.e., magenta donor patch 36.1) in the first donor patch set 32.1 are brought into alignment with receiving area leading edge LER of image receiving area 52 and the printing process is repeated to transfer further material to the image receiving area 52. This process is repeated for each donor patch thereby forming the complete image.

Returning to a discussion of FIG. 1, the printer controller 20 operates the thermal printer 18 based upon input signals from a user input system 62, an output system 64, a memory 68, a communication system 74, and sensor system 80. The user input system 62 can comprise any form of transducer or other device capable of receiving an input from a user and converting this input into a form that can be used by printer controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such user input systems. An output system 64, such as a display or a speaker, is optionally provided and can be used by printer controller 20 to provide human perceptible signals (e.g., visual or audio signals) for feedback, informational or other purposes.

Data including, but not limited to, control programs, digital images, and metadata can also be stored in memory 68. Memory 68 can take many forms and can include without limitation conventional memory devices including solid state, magnetic, optical or other data storage devices. In the embodiment of FIG. 1, memory 68 is shown having a removable memory interface 71 for communicating with removable memory (not shown) such as a magnetic, optical or magnetic disks. The memory 68 is also shown having a hard drive 72 that is fixed with thermal printer 18 and a remote memory 76 that is external to printer controller 20 such as a personal computer, computer network or other imaging system.

In the embodiment shown in FIG. 1, printer controller 20 interfaces with a communication system 74 for communicating external devices such as remote memory 76. The communication system 74 can include for example, a wired or wireless network interface that can be used to receive digital image data and other information and instructions from a host computer or network (not shown).

A sensor system 80 includes circuits and systems that are adapted to detect conditions within thermal printer 18 and, optionally, in the environment surrounding thermal printer 18, and to convert this information into a form that can be used by the printer controller 20 in governing printing operations. Sensor system 80 can take a wide variety of forms depending on the type of media therein and the operating environment in which thermal printer 18 is to be used.

In the embodiment of FIG. 1, sensor system 80 includes an optional donor position sensor 82 that is adapted to detect the position of donor ribbon 30, and a receiver position sensor 84 that is adapted to detect a position of the receiver media 26. The printer controller 20 cooperates with donor position sensor 82 to monitor the donor ribbon 30 during movement thereof so that the printer controller 20 can detect one or more conditions on donor ribbon 30 that indicate a leading edge of a donor patch set. In this regard, the donor ribbon 30 can be provided with markings or other optically, magnetically or electronically sensible indicia between each donor patch set (e.g., donor patch set 32.1) or between donor patches (e.g., donor patches 34.1, 36.1, 38.1, and 40.1). Where such markings or indicia are provided, donor position sensor 82 is provided to sense these markings or indicia, and to provide signals to controller 20. The printer controller 20 can use these markings and indicia to determine when the donor ribbon 30 is positioned with the leading edge of the donor patch set at thermal printhead 22. In a similar way, printer controller 20 can use signals from receiver position sensor 84 to monitor the position of the receiver media 26 to align receiver media 26 during printing. Receiver position sensor 84 can be adapted to sense markings or other optically, magnetically or electronically sensible indicia between each image receiving area of receiver media 26.

During a full image printing operation, the printer controller 20 causes donor ribbon 30 to be advanced in a predetermined pattern of distances so as to cause a leading edge of each of the donor patches (e.g., donor patches 34.1, 36.1, 38.1, and 40.1) to be properly positioned relative to the image receiving area 52 at the start each printing process. The printer controller 20 can optionally be adapted to achieve such positioning by precise control of the movement of donor ribbon 30 using a stepper type motor for motorizing donor ribbon take-up roll 48 or donor ribbon supply roll 50 or by using a movement sensor 86 that can detect movement of donor ribbon 30. In one example, a follower wheel 88 is provided that engages donor ribbon 30 and moves therewith. Follower wheel 88 can have surface features that are optically, magnetically, or electronically sensed by the movement sensor 86. In one embodiment, the follower wheel 88 that has markings thereon indicative of an extent of movement of donor ribbon 30 and the movement sensor 86 includes a light sensor that can sense light reflected by the markings. In other optional embodiments, perforations, cutouts or other routine and detectable indicia can be incorporated onto donor ribbon 30 in a manner that enables the movement sensor 86 to provide an indication of the extent of movement of the donor ribbon 30.

Optionally, donor position sensor 82 can be adapted to sense the color of donor patches on donor ribbon 30 and can provide color signals to controller 20. In this case, the printer controller 20 can be programmed or otherwise adapted to detect a color that is known to be found in the first donor patch in a donor patch set (e.g., yellow donor patch 34.1 in donor patch set 21.1). When the color is detected, the printer controller 20 can determine that the donor ribbon 30 is positioned proximate to the start of the donor patch set.

Figure 4:
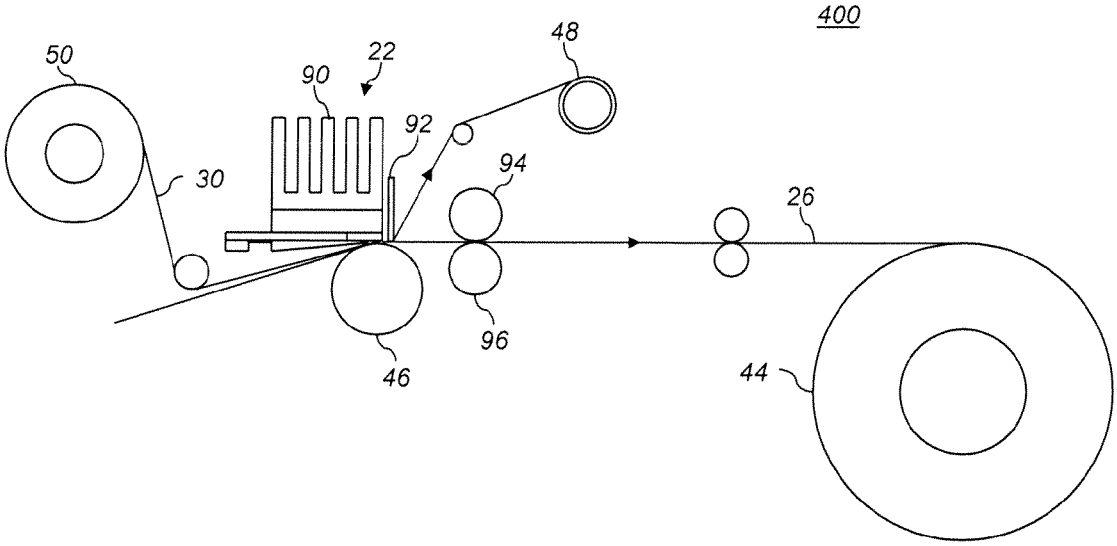
FIG. 4 is a diagram illustrating components of a thermal printing system.

A schematic showing additional details for components of a thermal printing system 400 according to one embodiment is shown in FIG. 4. Donor ribbon supply roll 50 supplies donor ribbon 30. Donor ribbon take-up roll 48 receives the used donor ribbon 30. A receiver supply roll 44 supplies receiver media 26. Receiver media 26 and donor ribbon 30 are merged together between platen roller 46 thermal printhead 22, which includes a heat sink 90 and a peel member 92. Subsequent to the thermal printhead 22 transferring donor material from the donor ribbon 30 to the receiver media 26, the peel member 92 separates the donor ribbon 30 from the receiver media 26. The donor ribbon 30 continues to travel on to the donor ribbon take-up roll 48, while the receiver media 26 travels between a pinch roller 94 and a micro-grip roller 96 that form a nip.

There are many applications where it is desirable to print images on both sides of the receiver media 26. For example, photo calendars and photo book pages generally have photographs or other content (e.g., text and graphics) printed on both sides of each page. To print duplex thermal prints, the receiver media 26 should have dye receiving layers coated on both sides of a substrate. Various arrangements can then be used to transfer dye onto both sides of the receiver media 26.

Figure 5:
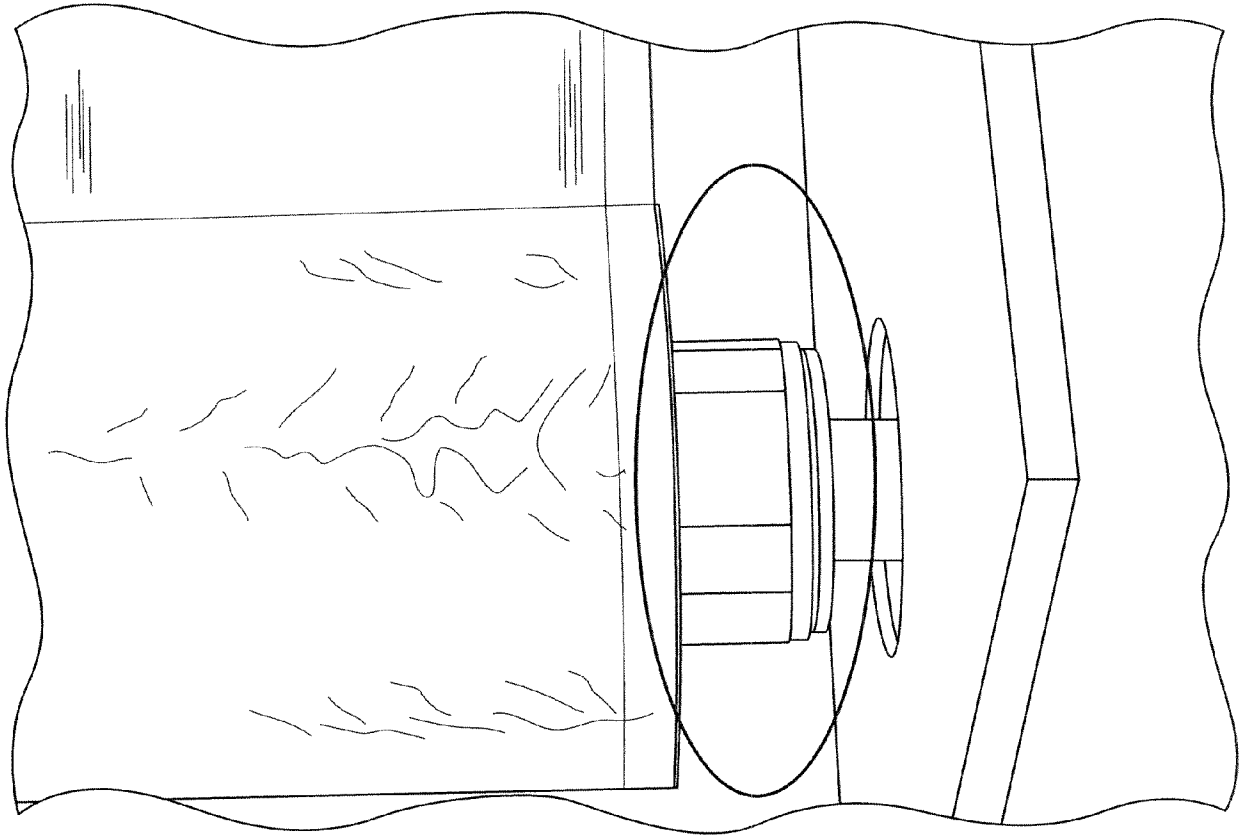
FIG. 5 shows a donor dye supply roll bar code label.
Figure 6:
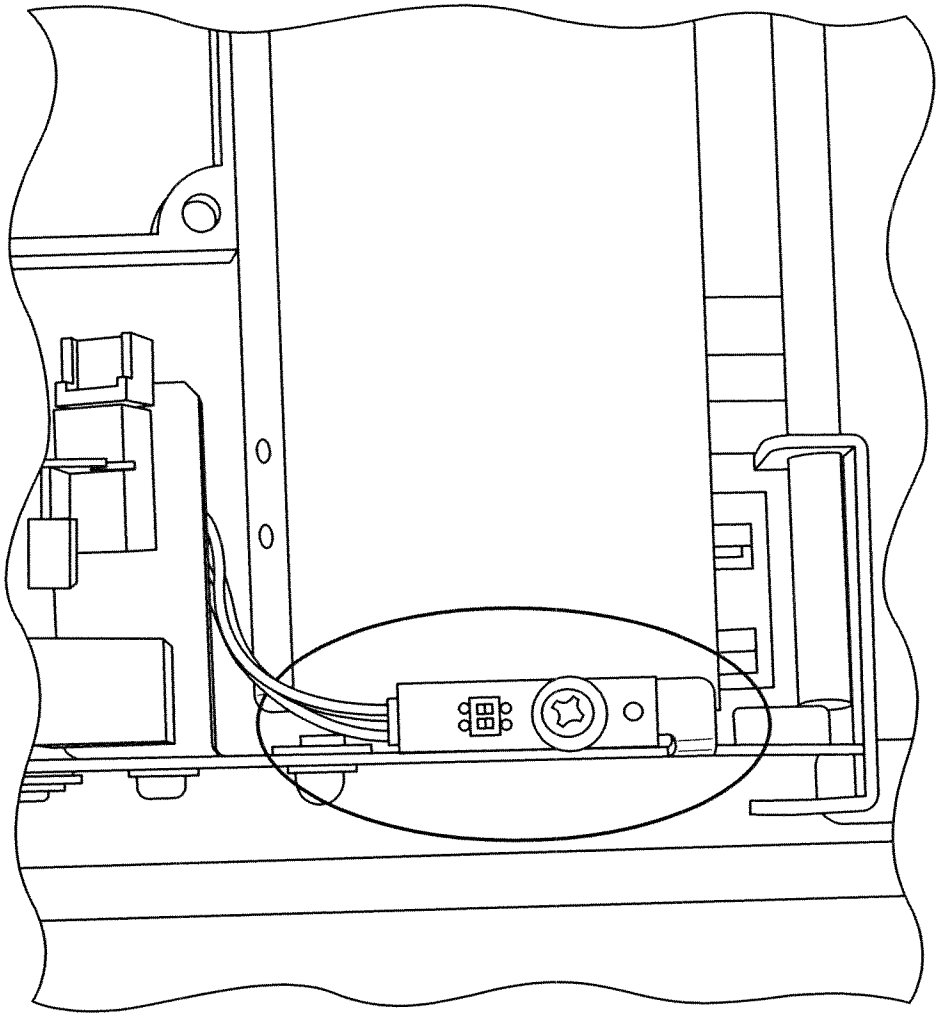
FIG. 6 shows a bar code sensor on an exemplary thermal printer.
Figure 7:
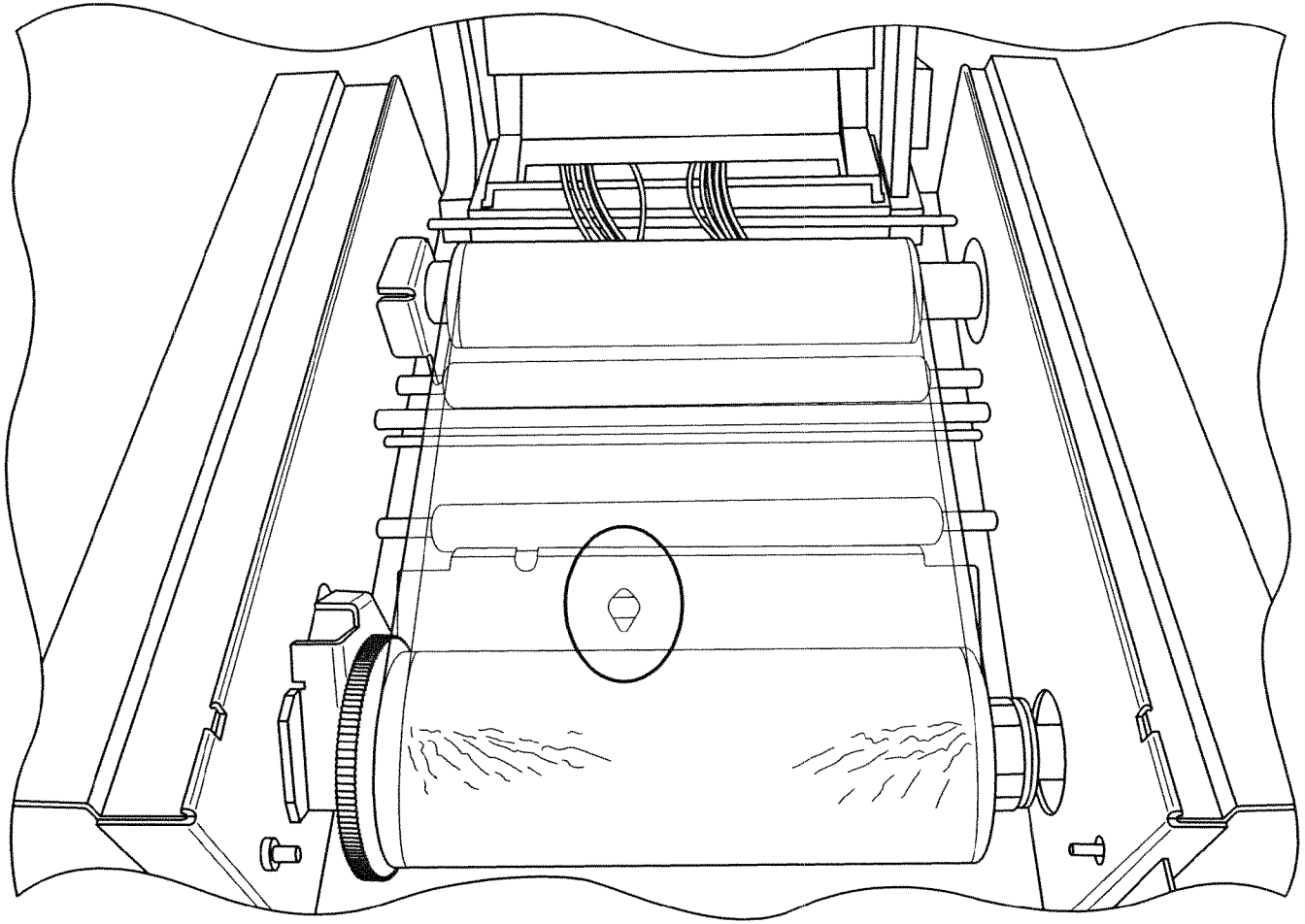
FIG. 7 shows a color patch red-green-blue ("RGB") emitter on an exemplary –10 show various printing components.
Figure 8:
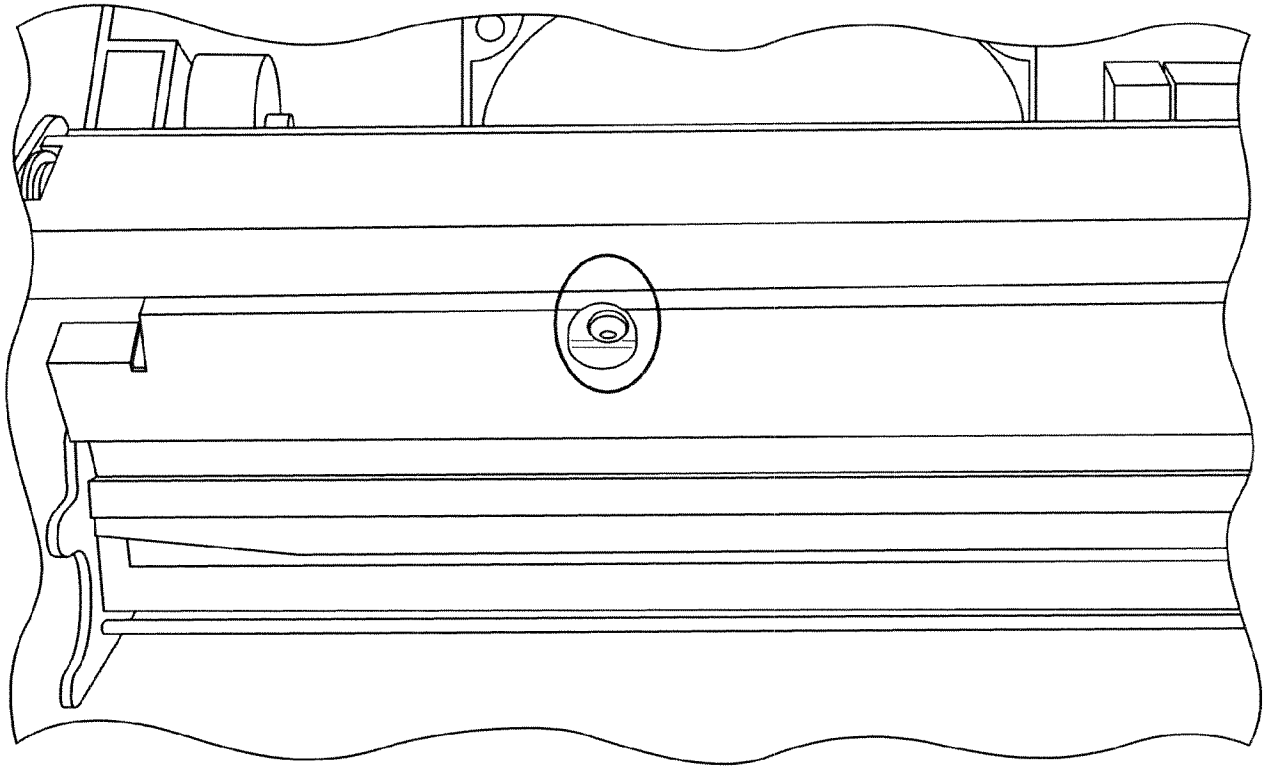
FIG. 8 shows a color patch RGB detector on an exemplary thermal printer.

FIGS. 5-8 illustrate various hardware aspects of prior art thermal printers. FIG. 5 shows a bar code label affixed to a donor media supply spool. FIG. 6 shows a bar code sensor on an exemplary thermal printer. Current systems use the bar code sensor of FIG. 6 to read the donor media bar code label depicted in FIG. 5. FIG. 7 shows a color patch red-green-blue (RGB) emitter on an exemplary thermal printer. FIG. 8 shows a color patch RGB detector on an exemplary thermal printer. Current systems may use the combination of an RGB emitter and RGB detector to sense the position and color of the donor media supply roll.

Figure 9:
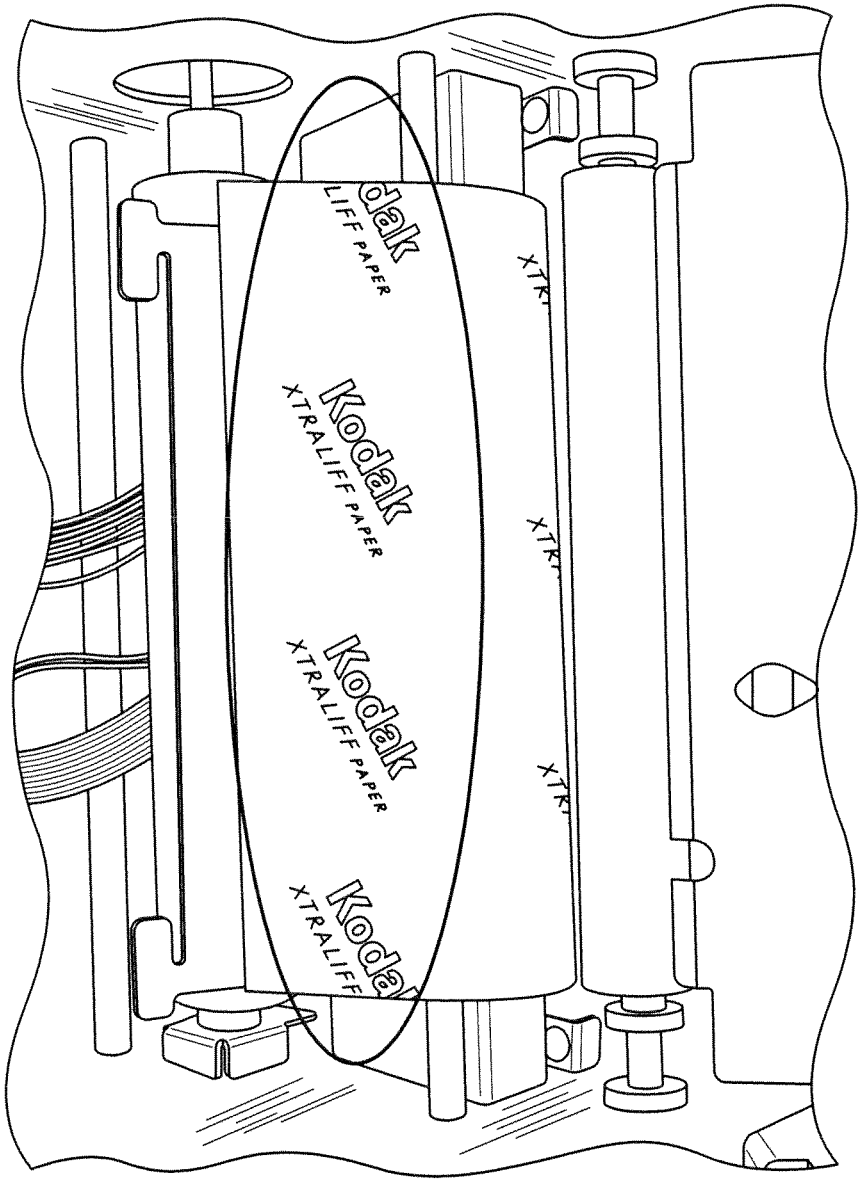
FIG. 9 shows an example of a printing pattern on the back of a paper supply roll in a thermal printer.
Figure 10:
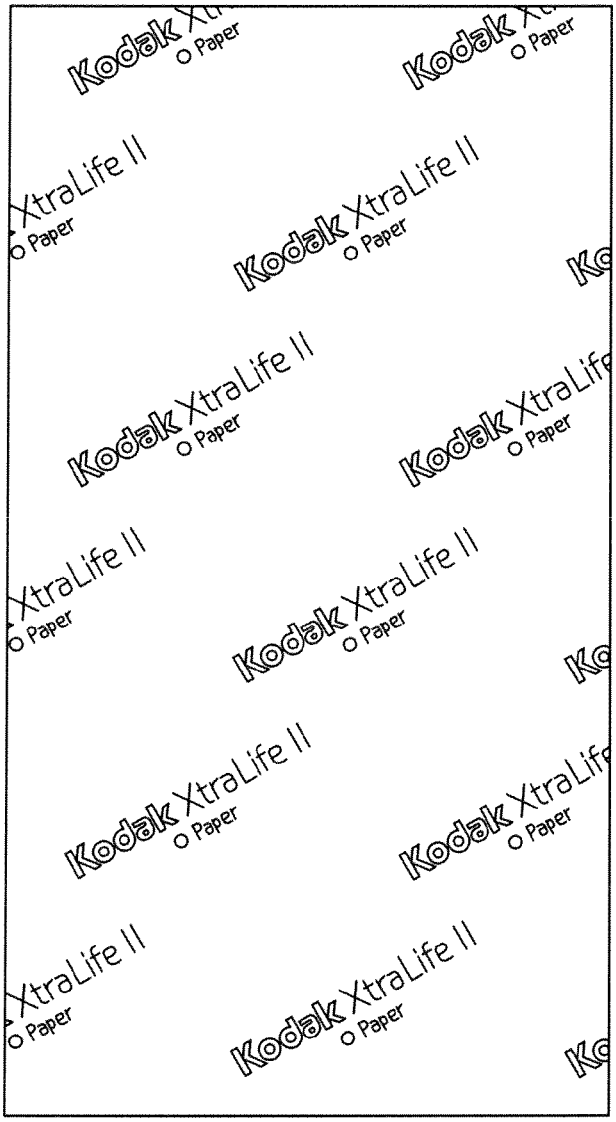
FIG. 10 shows an example of the printing pattern on the back of a paper supply roll in a thermal printer with a scale to indicate the size of the printing pattern.

Receiver media may have a pattern printed on one side, as illustrated in FIGS. 9 and 10. FIG. 9 shows an example of a printing pattern on the back of a paper supply roll in a thermal printer. FIG. 10 illustrates an embodiment of a particular type of simplex receiver media. For certain simplex (one-sided printing) receiver media, a backside (or non-imaging side) of the media contains a printed pattern. It should be understood that not all simplex media has a pattern printed on the backside of the media. As illustrated in FIG. 10, the backside printing pattern is repetitive, and for the particular media shown, the pattern repeats every 100 mm Therefore, driving the receiver 100 mm would ensure that at least one reading from the emitter detector sensor would be through a non-printed back portion of the supply roll.

FIG. 11 shows an example of expected responses from the RGB detector based on the light emitted by the RGB emitter and the donor dye patch positioned between the RGB emitter and the RGB detector. For example, when the emitter emits red light, the response at the detector is low if the Cyan donor patch is positioned between the emitter and the detector, and high if another patch is in position.

Figure 12:
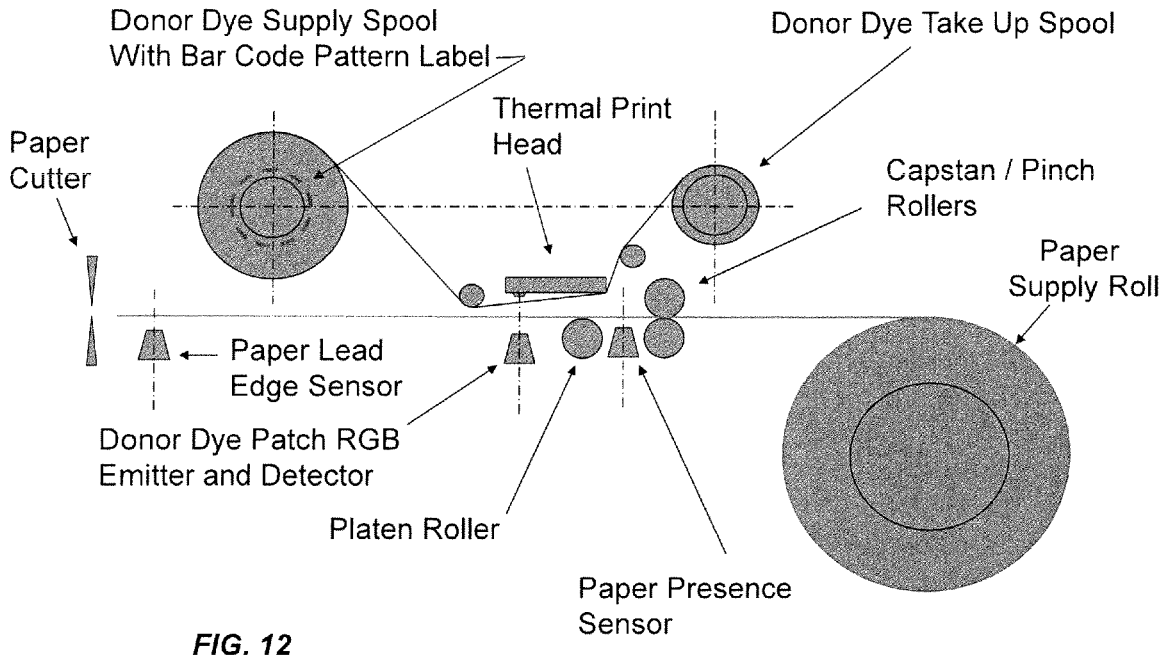
FIG. 12 shows a system for detecting media type in a thermal printer according to an embodiment of the present invention.

FIG. 12 illustrates the operative components that may be used to implement methods of the current invention in one embodiment.

Figure 13:
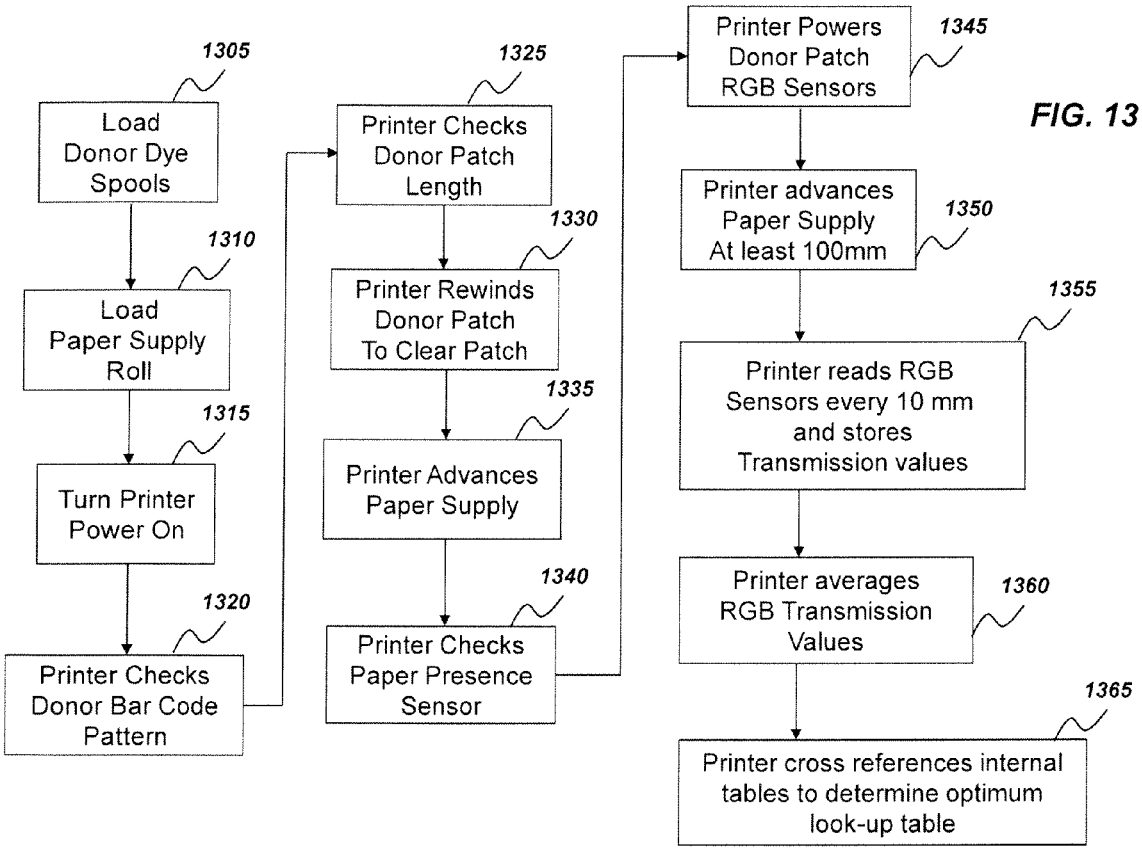
FIG. 13 describes a flowchart for a method for detecting media type in a thermal printer according to an embodiment of the present invention.

FIG. 13 illustrates an embodiment of a method for detecting media type in a thermal printer according to an embodiment of the present invention. In steps 1305 and 1310, respectively, the donor dye spool and paper (receiver) supply roll are loaded into the thermal printer. Once the printer is loaded with donor and receiver media, the power is turned on in step 1315. Upon boot up, the printer initializes by checking the donor bar code pattern in step 1320. Next, in step 1325, the printer checks the donor patch length. To do this, the RGB emitter transmits light through the donor media as the donor media is driven forward from the supply spool toward the take-up spool. The RGB detector reads the voltage transmissions as the donor advances in the printer. When the RGB detector registers a change in voltage transmission, then the printer's firmware knows that that the donor element has progressed from one dye color patch to the next dye color patch. Through this process, the printer can determine the length of the donor patch. Different donor media may have different length dye color patches depending on the type of prints that are desired. For instance, a printer with an output setting for 5×7 prints requires a different donor media than a printer with an output setting for 6×8 prints.

By performing step 1325, the printer can verify that the donor media has the correct dye donor patch size for the selected output setting. It should be understood that the RGB emitter may transmit light continuously or may only transmit light during start-up initialization processes, such as to determine donor patch length and to determine receiver type, as described by the following disclosure. In step 1330, the printer rewinds the donor media to a position where the clear laminate overcoat patch resides in between the RGB emitter and RGB detector. It should be understood that the donor media can be rewound to any position, with any one of the color dye patches residing in between the RGB emitter and RGB detector at step 1330.

Next, the printer determines the receiver media type. In step 1335, the printer advances the paper (receiver) supply to a position past the paper presence sensor. Once the paper presence sensor confirms that the receiver media is in the printing path, the printer engages the RGB emitter and RGB detector at step 1345. While maintaining the donor media position stationary, the receiver media is advanced in the printing path so as to pass between the RGB emitter and RGB detector. While the receiver advances past the RGB emitter/detector in the printing path, the RGB emitter transmits light through the donor and receiver media. The RGB detector picks up, or detects, the voltage transmission (or voltage response) of the RGB emitter's color light transmission. In the embodiment shown in FIG. 13, the receiver is advanced from a first position to a second position (at least 100 mm in FIG. 13). Other embodiments may not require that the receiver be advanced a specific distance. The present embodiment requires that the receiver advances a sufficient amount while the RGB emits sporadic light transmissions so as to create a voltage transmission profile.

According to an embodiment of the present invention, the emitter illuminates the receiver only while the receiver advances from a first position to a second position. As mentioned before, certain embodiments provide that light emanates from the emitter at certain steps of boot-up and initialization. In this step, a receiver position sensor will determine when the receiver begins advancing along the printer path and will determine the receiver's position concurrently as it moves along the printer path. In one embodiment, the emitter turns on to determine donor patch length (as described previously) and then turns off upon completion of that step. It may turn back on again—i.e., illuminate—upon the receiver position sensor detecting the presence of the receiver in the printing path. In another embodiment, the emitter illuminates the receiver at predetermined intervals as the receiver advances from the first position to the second position. The predetermined intervals can be time-based or distance-based. For example, the emitter can illuminate the receiver every 2 seconds and the emitter can illuminate the receiver every 2 mm that the receiver advances along the printer path between a first position and a second position.

A voltage transmission profile is the specific voltage transmission caused by the receiver over time as the receiver advances through the printer path. A single receiver can have multiple transmission profiles, where each profile corresponds to a specific donor media patch. For example, in the embodiment shown in FIG. 13, the transmission profile will be a function of the clear overcoat donor patch because the RGB emitter sends colored light through the clear patch and the receiver. Thus, the transmission voltage detected by the RGB detector corresponds to the receiver advancing under the clear donor patch. As mentioned previously, the donor may rewind to any position in step 1330. Accordingly, it may rewind such that the yellow, magenta, or cyan color patch reside between the RGB emitter/detector position. As shown in FIG. 11, the RGB emitter/detector response varies depending on which donor patch the light passes through. Accordingly, the receiver will generate a different voltage transmission profile depending on the positioning of the donor rewind in step 1330 (i.e., depending on which donor patch resides between the emitter and detector).

Further in the embodiment shown in FIG. 13, the printer reads the RGB sensor every 10 mm and stores the transmission values at step 1355. In step 1360, the printer averages the RGB transmission values. The averaged RGB transmission values form the particular voltage transmission profile. Thus, in the embodiment of FIG. 13, the RGB sensors take 10 voltage transmission readings as the receiver advances along the printer path (the receiver takes a reading every 10 mm over the course of the receiver advancing 100 mm) In step 1360, these 10 voltage transmissions are averaged to generate the voltage transmission profile. It should be understood that the printer can take sporadic, recurring RGB transmission readings as the receiver advances through the printing path. In other words, the receiver, in step 1350, may advance from a first position to a second position in the printing path. While advancing in the printing path, the printer may perform a plurality of RGB sensor readings at step 1355. The printer memory (FIG. 1) can store the averaged RGB voltage transmission readings (i.e., the transmission profiles) as a unique identify for the receiver media that is loaded into the printer. It may be understood that the printer can perform an initialization process to determine a receiver media's four transmission profiles (one corresponding to each of the donor media patches) by performing iterations of steps 1330 to 1360. After this initialization, the four profiles will be stored in the printer's memory as unique identifiers of the particular receiver media. In the final step 1365, the printer takes the averaged RGB transmission value (or transmission profile) that was determined in step 1360 and cross-references internal tables stored in the printer's memory. Such internal tables may be the compilations of a plurality of initializations, wherein one or more transmission profiles for one or more types of receiver media are stored. By cross-referencing the internal tables, the printer's firmware should be able to identify the particular receiver media. With knowledge of the type of receiver media, the printer's firmware can further determine the optimum look-up table (LUT).

Further, an embodiment of the present invention further provides for assigning a confidence value to the determination of receiver type based on the method described in the preceding paragraphs. To do so, the receiver advances in a first direction to generate a first transmission profile according to the aforementioned methods. Then, the receiver advances in a second direction to generate a second transmission profile according to the aforementioned methods. The first voltage response profile is then compared to the second voltage response profile to determine (or generate) an error (or deviation) between the two transmission profiles. The receiver type is thus determined according to steps 1360 and 1365, described previously. Lastly, a confidence value is assigned to the determination of the receiver type based on the error, or deviation, between the two transmission profiles.

FIG. 14 illustrates an internal table used to determine the optimal LUT. The printer references such a table upon determining both the type of donor media and receiver media according to the aforementioned methods. The various LUTs (LUT 1-9) correspond to variable printing specifications that optimize print quality for different combinations of donor and receiver type. For example, if the printer determines the donor is type "B" and determines that the paper (receiver) is type "C," then the printer will print according to the printing specifications of LUT 8. Printing specifications can include energy output parameters that govern how much heat dissipates through the thermal printhead during the multi-stage printing process.

Figure 16:
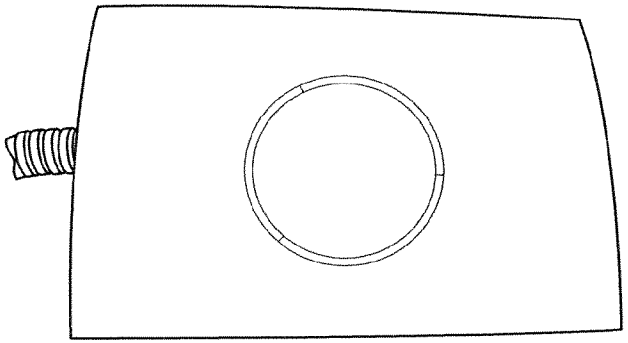
FIGS. 15-18 illustrate the different amounts of light from an RGB emitter that are transmitted through various media types.
Figure 18:
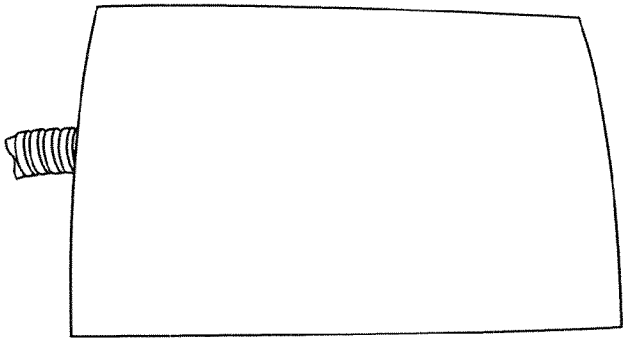
Figure 15:
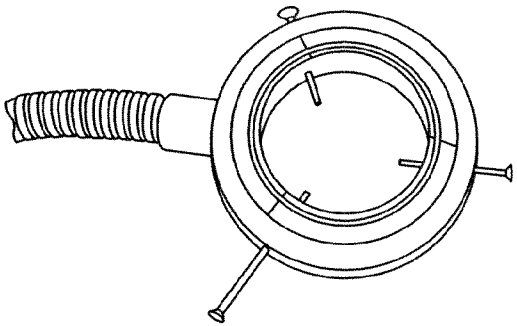
Figure 17:
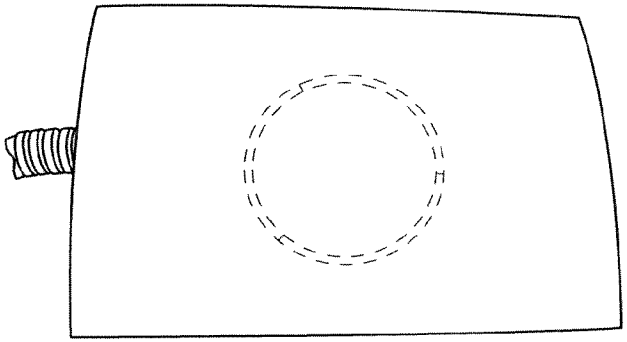

FIG. 15 shows a light source with a red, green, and blue filter similar to the tri-color emitter used for thermal donor color patch detection. While not necessarily the same configuration and shape, the light source of FIG. 15 represents tri-color emission hardware that may be implemented as RGB emitter. FIG. 16 shows the red, green, and blue transmission level through the thermal receiver. With reference to the RGB emitter/detector in the thermal printer, the tri-color detector senses either a red, green, or blue transmission level, or a combination thereof that may be used to identify that particular thermal receiver as compared to a different composition of thermal receiver. Unique transmission profiles are created and stored within the printer's firmware based on the RGB transmission levels. FIG. 17 shows a different level of RGB transmission through the thermal receiver. The intensity of the RGB light source in FIGS. 15-18 remains constant. Accordingly, the thermal receiver depicted in FIG. 16 as compared to FIG. 17 is different based on RGB transmission levels. Thus, as is visible by comparing FIG. 16 with FIG. 17, the receiver types in the two figures are different. The printer would readily determine that the two receiver media types are different via the RGB emitter/detector. The detector would register the particular voltage transmissions for each type of receiver media, which as can be seen, are quite different. For demonstration purposes, FIG. 17 has two thicknesses of thermal receiver which directly impacts the RGB transmission level. FIG. 18 shows a "0" level of RGB transmission (opaque) through the thermal receiver. In other words, none of the light emitted by the RGB emitter transmits through the receiver type shown in FIG. 18. Again, the intensity of the RGB light source remains constant throughout FIGS. 15-18. Therefore, the thermal receiver identified in FIG. 18 as compared to FIG. 16 or FIG. 17 is different based on RGB transmission levels.

The invention has been described in detail with particular reference to certain preferred embodiments thereof, but it will be understood that variations and modifications can be effected within the spirit and scope of the invention.

The invention claimed is:

1. A method for determining a receiver type in a thermal printer, wherein the thermal printer comprises a thermal print head, a plurality of rollers, an emitter, and a detector, the method comprising:

using one or more rollers to advance the receiver between the emitter and the detector;

the emitter illuminating the receiver;

the detector registering a voltage transmission based on the illumination of the receiver;

generating a measured voltage transmission profile;

receiving a set of known voltage transmission profiles; and comparing the measured voltage transmission profile to the set of known voltage transmission profiles to determine the receiver type, wherein the receiver type comprises paper, transparency material, sticker material, and cloth material.

2. The method of claim 1, wherein the thermal printer further comprises a receiver position sensor, and wherein the emitter illuminates upon the receiver position sensor detecting the receiver.

3. The method of claim 1, wherein the emitter illuminates the receiver only while the receiver advances from a first position to a second position.

4. The method of claim 3, wherein the emitter illuminates the receiver sporadically as the receiver advances from the first position to the second position.

5. The method of claim 4, further comprising:

the detector registering a plurality of voltage transmissions caused each time the emitter illuminates the receiver sporadically as the receiver advances from the first position to the second position; and generating a measured voltage transmission profile based on an average of the plurality of voltage transmissions.

6. The method of claim 3, wherein the emitter illuminates the receiver at predetermined intervals as the receiver advances from the first position to the second position.

7. The method of claim 1 wherein the receiver advances in a first direction to generate a first profile of voltage responses.

8. The method of claim 7 further comprising moving the receiver in a second direction to generate a second profile of voltage responses.

9. The method of claim 8 further comprising:

comparing the first profile of voltage responses with the second profile of voltage responses to generate an error between the first and second profiles of voltage responses; and assigning a confidence value to the determination of receiver type based on the error.

10. The method of claim 1, wherein the emitter illuminates the receiver with a multi-colored light.

11. The method of claim 1, wherein the voltage transmission is measured at a predetermined sampling rate.

12. The method of claim 1, wherein the voltage transmission is measured continuously.

13. The method of claim 1, further comprising a printer controller controlling the amount of heat generated by the thermal print head during printing based on the determined receiver type.

14. The method of claim 1, wherein prior to advancing the receiver between the emitter and the detector, one or more of the rollers positions a clear overcoat patch of a donor medium between the emitter and the detector.

15. A method for optimizing printing quality by a thermal printer loaded with a donor medium and a receiver medium, the method comprising:

determining the type of donor medium installed;

determining the type of receiver medium installed according to the method of claim 1;

the printer controller using the known donor medium type and the known receiver medium type to determine the optimum look-up table, wherein the optimum look-up table comprises optimum printing specifications; and printing according the optimum printing specifications of the optimum look-up table.

16. A system for determining receiver type in a thermal printer, wherein the thermal printer has a thermal print head and a printing zone in which colorant from a donor medium transfers to the receiver in response to the thermal print head producing heat, the system comprising:

an emitter located proximate to the printing zone of the thermal printer for illuminating the receiver;

a detector located proximate to the printing zone of the thermal printer for producing a voltage response based on the illumination of the receiver when the receiver is moved through the printing zone of the thermal printer; and a processor configured to generate a profile of measured voltage responses, to receive a set of known profiles of voltage responses associated with known receiver types, and to determine the receiver type by comparing the profile of measured voltage responses with the set of profiles of voltage responses associated with known receiver types, wherein the receiver types comprise paper, transparency material, sticker material, and cloth material.

17. The system of claim 16, wherein the processor is further configured to control the amount of heat generated by the thermal print head based on the determined receiver type.

18. The system of claim 16, wherein the voltage response produced by the detector is measured at a predetermined sampling rate.

19. The system of claim 16, wherein the voltage response produced by the detector is measured continuously.

* * * * *